US006916252B2

(12) United States Patent
Bennett

(10) Patent No.: US 6,916,252 B2
(45) Date of Patent: Jul. 12, 2005

(54) GOLF CLUB PUTTER HEAD

(76) Inventor: John Emmanuel Bennett, 1570 Homewood Dr., Altadena, CA (US) 91001

( * ) Notice: Subject to any disclaimer, the term of this patent is extended or adjusted under 35 U.S.C. 154(b) by 0 days.

(21) Appl. No.: 10/223,716

(22) Filed: Aug. 20, 2002

(65) Prior Publication Data

US 2004/0038748 A1 Feb. 26, 2004

(51) Int. Cl.[7] ..... A63B 53/04
(52) U.S. Cl. ..... 473/341; 473/313; 473/305
(58) Field of Search ..... 473/313, 251, 473/340, 341

(56) References Cited

U.S. PATENT DOCUMENTS 4,898,387 A * 2/1990 Finney ..... 473/341
5,580,058 A * 12/1996 Coughlin ..... 273/250
5,910,055 A * 6/1999 Bennett ..... 473/305
5,997,409 A * 12/1999 Mattson ..... 473/244
6,634,956 B1 * 10/2003 Pegg ..... 473/251

* cited by examiner

*Primary Examiner*—Glenn Caldarola
*Assistant Examiner*—Tom Duong

(57) ABSTRACT

This invention of a golf club putter head, attempts to minimize torque and wobble of the club head by placing two especially designed weights at the rear of the club head so that they are aligned with the sides of the ball. These two weights work together and impart a force to the ball on its sides as well as at its center. The result is that, there is less torque on the club head because of the disposition of the weights in the proximity of the ball and shorter torque arm leverage which minimizes the intensity of the torque. The net result is that, we have a putter head which is stable, providing positive control of the putt and which feels natural and in line, in the back swing and down swing and at impact.

1 Claim, 2 Drawing Sheets

GOLF CLUB PUTTER HEAD

BACKGROUND OF THE INVENTION

The present invention relates to improvement of the current state-of-the-art putters which are unreliable and inadequate, to putt the golf ball under control the player. Thus, putting is an uncertain, uncontrolled, and intimidating demand in the game of golf and the reward from putting is often inconsistent with the overall skill and effort of the player. The common putters develope a torque during the swing, and have a wobble for which the player must compensate in all aspects of his swing. Thus, the player is uncertain while trying his best to maintain the club head perfectly square with the line of the ball target, and depends on luck to relieve the uncertainty of his efforts and the performance of the club head.

SUMMARY OF THE INVENTION

The golf putter is the most important club a player needs. The game is won or lost in the putting process. The game of golf is very frustrating and putting is the most agonizing part of the game. There really is no putter available that will perform as expected. All putters are about the same with weights at the ends or in middle, to prevent or minimize torque, but having no certain results.

This invention attempts to minimize torque by placing two especially designed weights at the rear of the club head so that they are aligned with the sides of the ball. These weights work together and impart a force to the ball on its sides as well as at its center. The result is that there is less torque because of the disposition of the weights in the proximity of the ball. The net result is that we have a putter head which is stable, providing positive control of the putt and which feels natural and in line in the back swing and down swing and at impact.

This invention achieves a club head for a golf putter, providing the player a positive tool to impact the ball according to his skill, confidence and feelings. Because of the unique construction of the present invention, the player will be able to strike the ball more decisively with confidence, so that the result of his putt will be more rewarding and according to his skill. The basic objective of the present invention is to be able to strike the ball with minimum distortion at impact and to do it with assurance of a favorable putt.

DESCRIPTION OF THE PREFERRED EMBODIMENT

Figure 3:
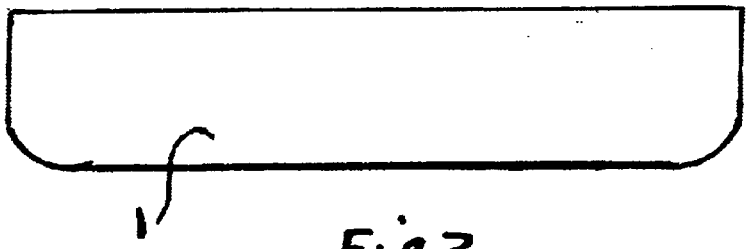
FIG. 3 is the front face view of the club head.
Figure 4:
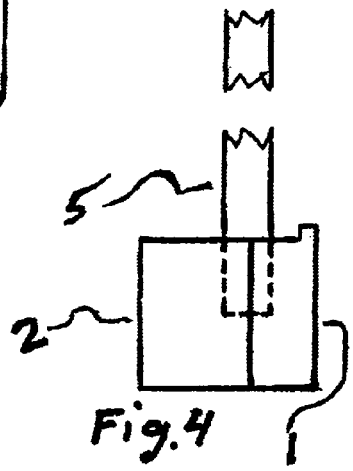
FIG. 4 is the side view of the club head.

FIGS. 1–4 illustrate a golf putter comprising a club head body 8, a club head blade 1, two side weights 2 (FIGS. 1 and 2), a shaft 5, and a plate 3. The two weights are disposed at two calculated positions at the rear of the club head. The weights are calculated to be aligned to deliver a force to each side of the ball at impact. The design, orientation and location of the weights are critical. Further, it is determined that if the extended alignment, from the inner sides of the weights to the sides of the ball at impact, is less than 3.00 inches apart, preferably, 1.68 inches apart, positive and improved results are obtained from putter head, with the arrangement of the weights 2 as stated.

The positioning of the weights at the back of the blade, aligned with each side of the ball in the impact position, "cradles" the ball, creating a direct thrust and transfer of equal force at impact, at the immediate sides of the ball, with no significant torque or wobble. Further, this arrangement of weights with the ball, provides a larger "sweet spot" and with a balanced and controlled impact, enabling more number of accurate putts.

Figure 1:
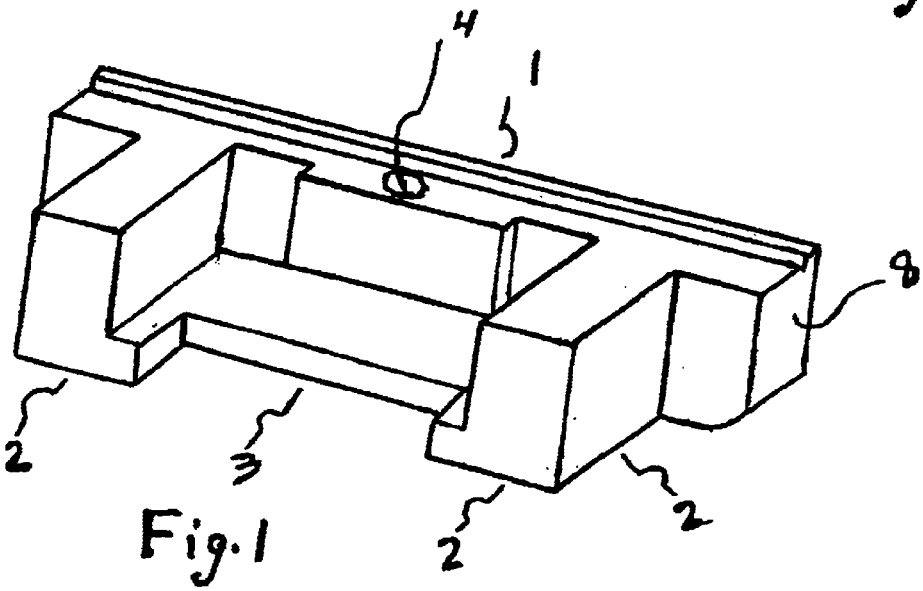
FIG. 1 is a perspective top angular view of the club head.

Referring to the drawings, FIG. 1 is an angular perspective view of the club head 8, which comprises a club head blade 1 and two identical weights 2, each positioned perpendicularly on the back surface of the club head blade 1.

The object and concept, of this invention, is to produce a club head that propels the ball, at impact, in a positive straight line with control of the ball, and no torque or wobble of the club head.

To accomplish this, two identical weights 2 (FIG. 1) are positioned at the back surface of the club head blade 1 so as to be aligned close to the sides of the ball, and, wherein, each weight is positioned, equidistant, less than 1.50 inches; preferably, 0.84 inch, from the center of the sweet spot. Thus, impacting the ball with equal forces, close to its sides, propels the ball forward in a straight line, with control and no deviation of the club head.

The two concentrated weights 2, positioned and aligned with the sides of the ball at the sweet spot, creates a larger area of sweet spot, enabling a more accurate putt more often, and with a better balance and "feel" of the club head.

The two weights 2, (FIG. 1), on the back of the club head 8, are positioned discretely, less than 3.00 inches apart, preferably, less than 1.68 inches apart, and wherein the diameter of a standard golf ball, per USGA, is 1.68 inches.

The two identical weights 2, (FIG. 1) are perpendicularly and symmetrically positioned at the rear surface of the club head blade 1 extend equally and perpendicularly rearward.

Each weight is less than 1.500 inches long, 0.700 inch wide and 0.875 inch high, preferably, 0.875 inch long, 0.500 inch wide, and 0.875 inch high, preferably, 0.875 inch long, 0.500 inch wide.

Figure 2:
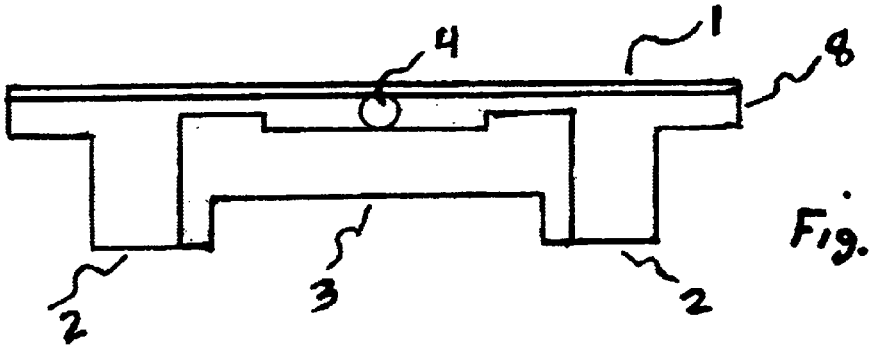
FIG. 2 is the top view of the club head.
Figure 7:
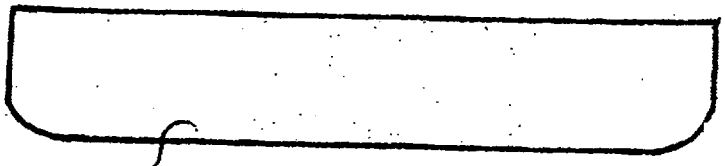
FIG. 7 is the front view of the club head.
Figure 8:
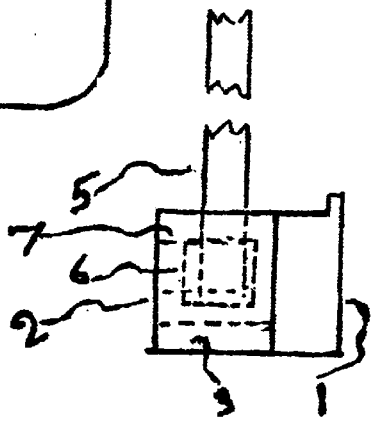
FIG. 8 is the side view of the club head as shown in FIGS. 5 and 6.
Figure 5:
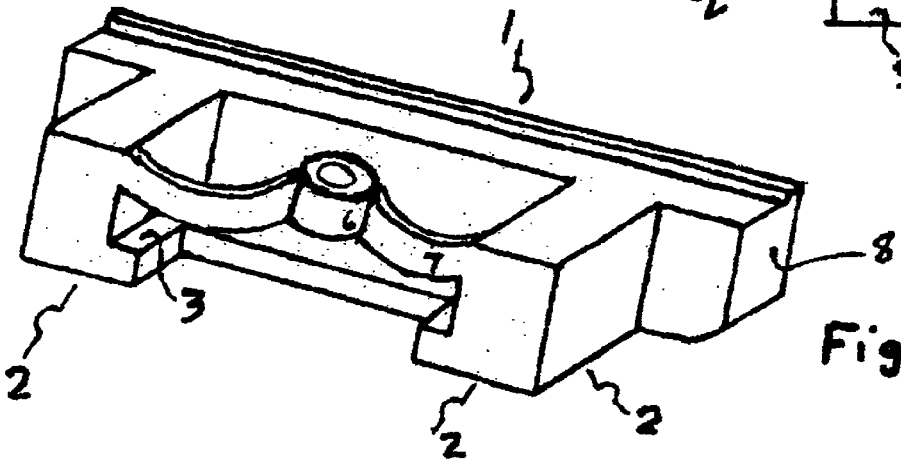
FIG. 5 is a side view of another modified embodiment of the club head.
Figure 6:
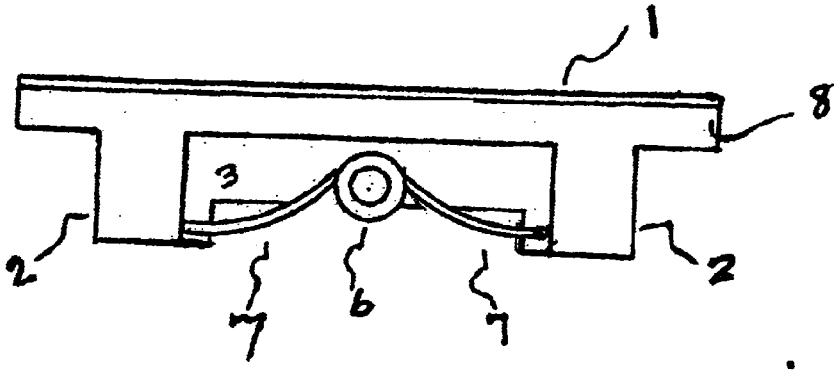
FIG. 6 is a top view of the club head as shown in FIG. 5.

Further, the club head 8 embodies a hole 4, (FIG. 1) at its top surface for the insertion and attachment of the club shaft 5. Referring to FIGS. 5–7, another embodiment of the club head of FIGS. 1–2 is illustrated with an additional shaft mounting sleeve 6 and straps 7. The shaft mounting sleeves 6, (FIG. 5) is mounted at the rear of the club head 8 between the two weights 2, by means of extended members 7 from the inner sides of the weights, providing an alternative means for mounting the club shaft 5. The straps suspend the mounting sleeve 6 as shown in FIG. 8 to provide a balance club head.

A plate 3, (FIG. 5), less than 0.075 inch thick, is attached to the sides of the weights at their inner sides, and also to the back side of the club head blade 1 at the bottom of the club head 8, to lower the club head center of gravity and to improve the roll of the ball and the feel of the swing of the club head.

The club head, described herein, is made as a unit from a casting, or machining from materials such as steel, brass, aluminum, or their combinations.

What is claimed is:

1. A unique golf club putter head comprising:

a shaft inserted into a shaft mounting sleeve; a club face for striking a golf ball;

a golf putter head having a body with top and bottom surfaces, two end surfaces, and longitudinal front and back surfaces;

a hole disposed at said top surface for the insertion and attachment of the club shaft;

a plate having a thickness less than 0.375 inch is attached to the inner sides of said weights and also to the back of said club face at the bottom of said club face in order to lower the center of gravity of the club head and to improve the roll of said ball;

two identical weights are positioned discretely, less than 3.00 inches apart, preferably 1.68 inches apart on said back surface of said club head blade;

said each weight is positioned equidistant less than 1.50 inches, preferably 0.841 inch, from the center of gravity of said back surface called the "sweet spot";

said each weight is aligned to be at the immediate side of the ball at the impact position;

wherein said golf ball is positioned at the sweet spot at the center of said club face;

wherein said equal and concentrated weight, aligned at each side of the golf ball while maintaining the club head in a fixed position when impacting the ball, resulting in a forward thrust of the ball in a straight line with no significant torque or wobble of the putter head;

wherein said two identical weights are rectangular in shape and symmetrically positioned at the rear surface of the club face to extend equal and perpendicularly rearward;

wherein each weight is less than, 1.500 inches long, 0.700 inch wide, and 0.875 inch high, preferably, 0.875 inch long, 0.500 inch wide and 0.875 inch high;

said shaft mounting sleeve is mounted at the rear of said club head between said two weights, by means of extended members from the inner sides of said weights; said extended members are horizontally connected to the inner sides of said weights, providing an alternative means for mounting said club head.

* * * * *